United States Patent [19]

Stadler et al.

[11] Patent Number: 4,482,876

[45] Date of Patent: Nov. 13, 1984

[54] ELECTROMAGNETIC RELAY

[75] Inventors: Heinz Stadler; Alfred Heinzl, both of Munich, Fed. Rep. of Germany

[73] Assignee: Siemens Aktiengesellschaft, Berlin & Munich, Fed. Rep. of Germany

[21] Appl. No.: 467,386

[22] Filed: Feb. 17, 1983

[30] Foreign Application Priority Data

Mar. 23, 1982 [DE] Fed. Rep. of Germany ..... 3210654

[51] Int. Cl.[3] ..... H01H 51/22

[52] U.S. Cl. ..... 335/83; 335/181; 335/187

[58] Field of Search ..... 335/78, 79, 80, 81, 335/82, 83, 128, 133, 148, 179, 181, 187, 196, 222

[56] References Cited

U.S. PATENT DOCUMENTS 2,695,346 11/1954 Robison ..... 335/81

3,688,229 9/1972 Bloch ..... 335/128

4,311,976 1/1982 Sauer et al. ..... 335/179

FOREIGN PATENT DOCUMENTS 1258862 12/1971 United Kingdom .

*Primary Examiner*—E. A. Goldberg

*Assistant Examiner*—George Andrews

*Attorney, Agent, or Firm*—Hill, Van Santen, Steadman & Simpson

[57] ABSTRACT

A relay comprises an elongate armature which is seated at one end in a carrier of insulating material. Movable contact springs are anchored in the carrier and comprise extensions which emerge from the carrier and are secured in a base with respective fastening portions. Such extension of the respective contact springs forms a terminal lug integrated as a one-piece structure with the contact, as well as a friction-free bearing for the armature without provision of an additional bearing element.

6 Claims, 1 Drawing Figure

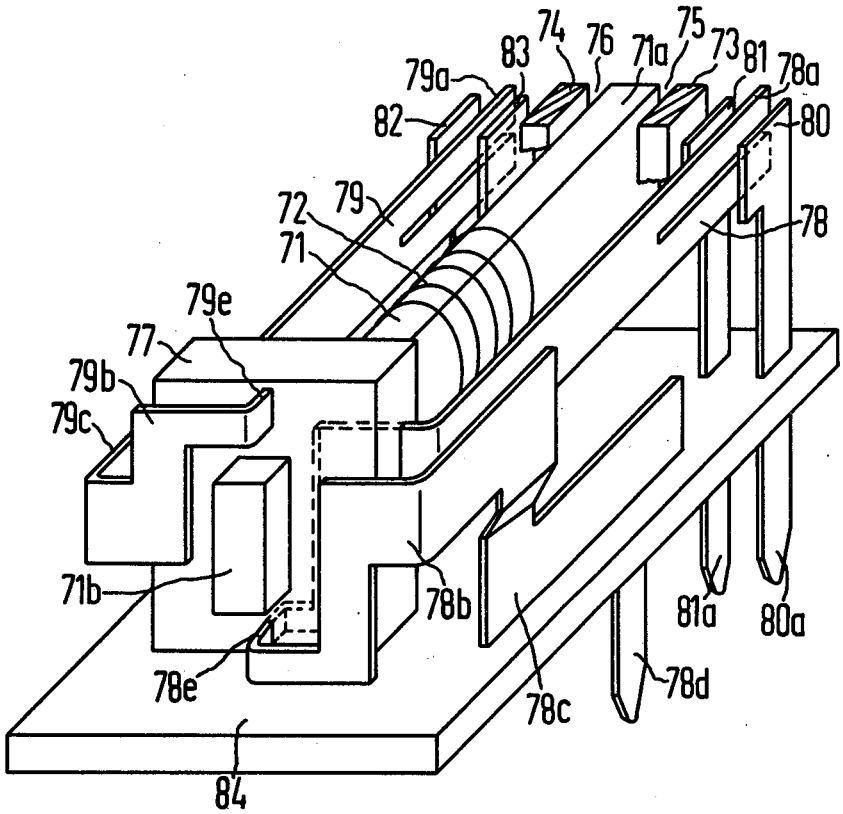
74
76
75
83
71a
73
81
78a
79a
80
82
72
79
78
71
79e
77
79b
79c
71b
78b
81a
80a
78e
78c
78d
84

ELECTROMAGNETIC RELAY

BACKGROUND OF THE INVENTION

1. Field of the Invention

The present invention relates to an electromagnetic relay, and is more particularly concerned with a relay having spring contacts which comprise an extension in the area of their mounting, the extensions of the contact springs forming terminal lugs which are secured in a base and serve as a resilient mounting of the armature carrier.

2. Description of the Prior Art

The German patent application No. P 31 32 239.5, corresponding to U.S. Ser. No. 407,236, fully incorporated herein by this reference, relates to an electromagnetic relay having an excitation coil and an elongate armature seated at one side which extends essentially parallel to the axis of the coil and to which at least one contact spring is secured in an insulated manner. The contact spring extends parallel to the armature and has a free end which cooperates with at least one cooperating contact element. A bar-shaped armature is seated at its one end in the area of a first coil flange over an insulating carrier and extends essentially over the entire coil length up to the second coil flange at the opposite end, whereby it forms a working air gap with at least one pole plate in the area of the second coil flange and whereby the contact springs anchored in the armature also essentially extend over the entire length of the coil and spaced from the armature.

The above-mentioned relay has the advantage that the direct fastening of the contact springs in the insulating carrier of the armature directly transmits the armature movement to the contact springs so that no actuation slide is required. However, given the exemplary embodiment described in that application, it is necessary to connect the contact springs, connected to the armature, and movable therewith, to their respective connection elements in a base body by way of stranded conductors. Such stranded conductor connections are relatively expensive and involved to manufacture. Moreover, the insulating carrier of the armature must be seated at the coil body by way of suitable measures, this producing unavoidable friction. When, moreover, the armature is to exhibit a bias or, respectively, restoring force, then such force must be exerted by an additional spring.

SUMMARY OF THE INVENTION

The object of the present invention, therefore, is to provide a further development of the relay mentioned above in such a manner that the stranded conductor connections for the movable contact spring can be eliminated and the bearing friction of the armature is avoided at the same time.

Given a relay of the type set forth above, and according to the present invention, the above object is achieved in that the contact springs respectively exhibit an extension in the area of their anchoring in the carrier, the extension forming a terminal lug and being secured in a base body carrying the cooperting contact elements and serving as a resilient seating of the armature carrier.

As a result of the design of a relay in accordance with the present invention, therefore, the contact springs which are movable with the armature comprise, together with their terminal lugs, a one-piece construction which also simultanously assumes the seating of the armature. Therefore, a stranded conductor connector for the electrical connection of the contact springs is superfluous and the bearing friction of the armature is avoided at the same time. In addition, a desired restoring force for the armature can be generated by way of the spring seating without an additional reset element being necessary for this purpose.

A respective extension of the contact spring or, respectively, contact springs, advantageously emerges from the carrier in the respective area of the armature's axis of rotaton and, over one or more crimps, and forms a fastening part having an integrated terminal lug.

In accordance with a preferred embodiment of the invention, one contact spring is secured in the carrier at both sides of the armature, whereby the extension of the two contact springs emerge from the carrier offset relative to one another in the direction of the armature's axis of rotation. Thereby, the extension of the respective contact spring can exhibit a spring section reduced in cross section and stressed during the switch operation of the armature for flexure or torsion.

BRIEF DESCRIPTION OF THE DRAWING

Other objects, features and advantages of the invention, its organization, construction and operation will be best understood from the following detailed description of a preferred embodiment of the invention, taken in conjunction with the accompanying drawing, on which there is a single FIGURE which is a perspective pictorial view of a relay constructed in accordance with the invention.

An armature 71 is illustrated on the drawing and comprises an elongate ferromagnetic plate which is movably disposed in a coil body (not illustrated) which has a winding 72 which is only schematically illustrated. The armature 71 has a free end 71*a* which is movably disposed between two pole plates 73 and 74 and which forms respective working air gaps 75 and 76 relative to the pole plates 73 and 74. Only the ends of the pole plate 73 and 74 are illustrated. As with the entire magnetic system, the pole plates 73 and 74 can be designed, for example, in accordance with that relay of the aforementioned German patent application. The armature 71 is secured at its opposite end 71*b* in a carrier 77 of insulating material, being secured, for example, by embedding or by insertion therein.

Also secured in the carrier 77 are two contact springs 78 and 79 whose two spring legs respectively extend at both sides of the armature 71 parallel thereto and whose free ends 78*a* and 79*a* are disposed between respective pairs of contact elements 80, 81 and 82, 83, respectively, such that they selectively produce contact therewith. The cooperating contact elements 80, 81 and 82, 83 are secured in a schematically-illustrated base 84 in a conventional manner, for example, by way of embedding or insertion therein and form respective terminal lugs, for example the terminal lugs 80*a*, 81*a*, at the terminal side of the base 84.

Proceeding respectively from their anchoring in the carrier 77, the contact springs 78 and 79 form an extension 78*b*, 79*b*, respectively, which extends to a fastening section 78*c*, 79*c* extending parallel to the contact springs 78, 79 and which forms a respective terminal lug, for example 78*d*, below its anchoring in the base 84. The corresponding terminal lug of the contact spring 79 cannot be seen on the drawing. At the exit location from the carrier 77, the contact springs 78 and 79 respectively form a spring bar 78*e*, 79*e* which lies in the area of the axis of rotation of the armature and, as a result of its spring effect, exerts a restoring force on the armature together with the overall fastening elements 78*b*, 79*b*.

From its spring leg over its embedding in the carrier 77 and over the multiply-bent and crimped fastening part 78*b* up to the terminal lug 78*d*, therefore, the contact spring 78 is a one-piece element so that both the electrical current supply, as well as the seating of the carrier 77 with the armature 77 can be undertaken without additional elements. The bars 78*e*, 79*e* thereby serve as pivot bearings. Therefore, any and all bearing friction for the armature 71 is also eliminated. Of course, the contact springs 78, 79 with their connection parts can be modified so that, for example, respective torsion bars can be disposed in the rotational axis of the armature instead of the bars 78*e*, 79*e* which are loaded for flexure. The armature can be biased in a center position or in a lateral final position by way of an appropriate design and adjustment of the contact springs or, respectively, their fastening parts.

Moreover, the base can be designed for the receipt of the coil body (not illustrated) and further elements. For example, it can also be designed in a suitable manner for receiving a cover cap.

Although we have described our invention by reference to a particular illustrative embodiment thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. An electromagnetic relay comprising:

a base plate;

an insulating carrier mounted on said base plate;

an elongate armature including a first end mounted in said carrier and a free, second end;

an elongate excitation coil disposed about said armature and extending parallel to said base plate;

at least one pole plate mounted spaced from said second end of said armature to form a working air gap therewith;

at least one contact element mounted on said base spaced from said free, second end of said armature; and at least one contact spring including an intermediate section mounted in said carrier and a spring leg connected to said intermediate section and extending parallel to said coil and said armature, said contact spring further including a free end coupled to said armature and adjacent to said contact element, said free end moved by said armature to contact and break contact with said contact element upon energization and deenergization of said coil, and a carrier mounting section connected to said intermediate section and extending from said carrier and secured to said base plate forming a resilient mount for said carrier.

2. The electromagnetic relay of claim 1, wherein:

said carrier mounting section extends from said carrier at a location in line with the axis of rotation of said armature and includes a fastening portion comprising a terminal lug extending through said base plate.

3. The electromagnetic relay of claim 2, wherein:

said fastening portion extends, at least partially, parallel to said operating portion.

4. The electromagnetic relay of claim 2, wherein:

said terminal lug extends through said base plate at approximately the central area of the armature length.

5. The electromagnetic relay of claim 1, wherein:

said intermediate section of said contact spring includes a spring bar section extending through said carrier and connecting said spring leg and said carrier mounting section, said spring bar section stressed and flexed during switching operation of the armature.

6. An electromagnetic relay comprising:

a carrier;

an elongate armature including a first end embedded in said carrier and a free, second end;

an elongate excitation coil disposed about said armature;

a pair of pole plates spaced from and on opposite sides of said second end of said armature forming working gaps therewith;

a base plate;

first and second contact elements mounted on said base plate on opposite sides of said excitation coil; and first and second contact springs for cooperation with said first and second contact elements, respectively, each of said contact springs comprising a spring leg extending parallel to said elongate excitation coil and including a free end adjacent the respective contact element, an intermediate section connected to said spring leg and extending through said carrier, and a mounting section connected to said intermediate section and secured to said base plate and resiliently mounting said carrier, said intermediate sections emerging from said carrier in line with the axis of rotation of said armature and spaced from one another.

* * * * *